United States Patent [19]

Shore

[11] Patent Number: 4,718,325

[45] Date of Patent: Jan. 12, 1988

[54] HYDRAULIC SWING CONTROL FOR BOOM ASSEMBLY

[75] Inventor: Daniel B. Shore, Prospect Heights, Ill.

[73] Assignee: J. I. Case Company, Racine, Wis.

[21] Appl. No.: 926,216

[22] Filed: Nov. 3, 1986

[51] Int. Cl.[4] ..... F15B 15/22; F15B 13/04

[52] U.S. Cl. ..... 91/189 R; 91/402; 91/403; 91/408; 414/695.5; 414/694

[58] Field of Search ..... 414/694, 695.5; 91/189 R, 402, 403, 408

[56] References Cited

U.S. PATENT DOCUMENTS

| | | | |
|---|---|---|---|
| 4,007,845 | 2/1977 | Worback | 414/694 |
| 4,065,010 | 12/1977 | Worback | 414/694 |
| 4,085,855 | 4/1978 | Worback | 414/694 |
| 4,309,153 | 6/1983 | Pederson et al. | 414/695.5 |
| 4,344,733 | 8/1982 | Hirsch | 414/694 |
| 4,419,040 | 12/1983 | Pedersen et al. | 414/695.5 |
| 4,500,250 | 2/1985 | Maurer et al. | 414/695.5 |

*Primary Examiner*—A. Michael Chambers

*Attorney, Agent, or Firm*—Dressler, Goldsmith, Shore, Sutker & Milnamow, Ltd.

[57] ABSTRACT

An improved mechanism is provided for controlling the relative pivoting movement of two members about a main pivot axis as effected by two hydraulic motors. Each hydraulic motor is a double-acting piston-cylinder type that is fully extended when its respective line of action intersects the main pivot axis. Each hydraulic motor has an end port at each end. Two spaced-apart intermediate ports are provided within the piston stroke length of each motor. Pilot-actuated top dead center-selector valves are provided for reversing the flow to one of the hydraulic motors in response to a pressure differential between an end port and an intermediate port of the other of the hydraulic motors. Decelerator selector valves are provided to normally direct the return flow from the hydraulic motors so as to bypass a hydraulic cushioning circuit. The decelerator selector valves are pilot-actuated for directing the return flow to the cushioning circuit in response to a pressure differential between one of the end ports and one of the intermediate ports of either of the hydraulic motors.

11 Claims, 5 Drawing Figures

HYDRAULIC SWING CONTROL FOR BOOM ASSEMBLY

TECHNICAL FIELD

This invention relates generally to hydraulically actuated systems and more particularly to an improved hydraulic swing mechanism especially suited for pivoting the boom assembly of a backhoe or like implement.

BACKGROUND OF THE INVENTION AND TECHNICAL PROBLEMS POSED BY THE PRIOR ART

A conventional backhoe includes a frame which may be mounted on the rear of a tractor or like implement. The frame supports a boom assembly for pivotal movement with respect to the frame about a vertical axis. The boom assembly typically includes a bucket or other material-handling device for work operations, with articulation of the boom assembly by the backhoe operator providing material-handling in the desired fashion.

It is desired that the work operations be efficiently performed with the backhoe, and thus it is preferable to perform such operations in the shortest amount of time. Typically, such operations include a cycle of filling the bucket with material at one location, pivoting the boom assembly, dumping the material from the bucket at another location, and then pivoting the boom assembly back to the original location to end the cycle. The cycle is usually repeated many times.

In order to perform these operations as quickly as possible, the backhoe operator typically swings or pivots the boom assembly as rapidly as possible. In early backhoe designs, this frequently resulted in the boom assembly being forced hard against mechanical travel stops which limited the pivoting movement of the boom assembly. While this practice helped reduce the pivoting time during the work cycle, the practice was found to be detrimental to the structural components. On the other hand, if the operator exercised greater care during operation by manipulating the boom assembly swing control to slow the assembly before it reached the travel stop, then shock loading of the machine's components was reduced, but the extra care exercised by the operator increased the time for completing each cycle of backhoe operation.

In order to alleviate the problems caused by shock loading of the backhoe as the boom assembly is pivoted against a mechanical travel stop, various arrangements have been employed or proposed in the past to provide hydraulic cushioning of the boom assembly as it approaches the end of its arc of travel. One such prior art arrangement employs a "stinger" design which includes a projection carried by the piston of each hydraulic motor provided for swinging the backhoe boom assembly. As the boom assembly of the backhoe approaches the ends of its arc of travel, the stinger of one of the hydraulic motors acts to restrict the flow of hydraulic fluid from that motor, thus providing hydraulic cushioning of the boom assembly. While combination stinger/orifice cushioning arrangements have been widely used, their fabrication and maintenance have proven to be relatively expensive.

The U.S. Pat. No. 4,500,250 describes in detail an improved backhoe boom swing mechanism which includes a linkage assembly connecting the boom assembly with a sequencing spool valve. The spool valve is selectively operated as the boom assembly is pivoted through its arc of travel to direct the hydraulic motor discharge flow through a hydraulic cushioning circuit.

While this arrangement is a significant improvement and functions well, it would be desirable to provide a further improved arrangment that completely avoids the use of exposed mechanical devices, such as linkages and the like, that are vulnerable to being damaged as a result of operator error causing such devices to impact against external objects or as the result of external objects being moved against such devices. Further, it would be desirable to provide a further improved mechanism for controlling boom assembly swing that would be less susceptible to mechanical wear.

Another problem of conventional backhoe design relates to the use of double-acting piston-cylinder type hydraulic motors to pivot the boom assembly. Spatial limitations are a major consideration in positioning the hydraulic motors of the swing mechanism. The motors are usually positioned generally adjacent each other, and are pivotally interconnected between the frame of the backhoe and the boom assembly. In order to obtain the desired range of travel for the boom assembly (approximately 180 degrees), this configuration of the conventional swing mechanism results in one or the other of the hydraulic motors moving through a fully extended position when the boom assembly is moved beyond either end of a central range of travel of approximately 90 degrees. This fully extended position is frequently referred to as the "center position" for that hydraulic motor. As the boom assembly is moved toward the ends of its arc of travel, one of the two hydraulic motors moves through its fully extended center position and goes "overcenter", and then begins to contract. Each hydraulic motor of the swing mechanism moves through its center position whenever its centerline (i.e., line of action) intersects the vertical swinging axis of the boom assembly (i.e., when the axes of the pivot connections at each end of the hydraulic motor are coplanar with the main pivot axis of the boom assembly).

As one of the hydraulic motors of such a conventional swing mechanism moves to and through its center position, the moment arm through which it acts upon the boom assembly approaches zero at the center position, and then reverses 180° so that the overcenter hydraulic motor then exerts a negative torque on the boom assembly. Since the other (non-overcenter) hydraulic motor of the swing mechanism acts through a much greater moment arm than the overcenter motor, the boom assembly continues to move through its arc of travel. However, since the overcenter hydraulic motor exerts a negative torque on the boom assembly, the non-overcenter hydraulic motor must work to overcome this negative torque as it provides the primary force for pivoting the boom assembly.

The negative torque created by the overcenter one of the hydraulic motors is particularly a problem when the swinging movement of the boom assembly away from one of its travel stops is initiated, since inertial forces must be overcome. In this regard, a hydraulic swing mechanism for the boom assembly which includes an arrangement for redirecting the flow of hydraulic fluid to the hydraulic motors during swinging movement of the boom assembly so that the hydraulic motors are not, in essence, acting against each other, would provide a more efficient swing mechanism with improved control for the backhoe operator.

The special control linkage of the mechanism disclosed in the above-discussed U.S. Pat. No. 4,500,250 operates to actuate a multi-position spool valve to reverse direction of the hydraulic motor flow relative to one of the hydraulic motors when that one motor goes overcenter. Although this provides a significant improvement in the torque characteristics of the system, it would be desirable to provide an even further improved control mechanism that would not require an external control linkage that is subject to damage from accidental impact and mechanical wear. Further, it would be desirable to provide an even further improved control mechanism in which the hydraulic motor torque control could be efficiently combined in one hydraulic system with the devices for cushioning the boom assembly at the ends of its arc of travel.

SUMMARY OF THE INVENTION

An improved mechanism is provided for controlling the pivoting movement of an apparatus having two frame members. The apparatus includes two double-acting piston-cylinder type hydraulic motors which are each pivotally connected at each end to one of two frame members for effecting relative pivoting movement of the frame members through an arc about a main pivot axis. Each hydraulic motor is fully extended when its respective line of action intersects the main pivot axis.

A hydraulic system means is connected to the two hydraulic motors for supplying a flow of fluid under pressure from a source of fluid to each hydraulic motor and for returning the flow of fluid from each hydraulic motor to the source.

A cushioning means is connected with the hydraulic system for restricting flow from both hydraulic motors to the source during an end portion of the relative pivoting movement of the frame members through the arc of movement.

The control mechanism includes in each hydraulic motor a first port beyond one end of the piston stroke length, spaced-apart intermediate second and third ports within the piston stroke length, and a fourth point beyond the other end of the piston stroke length. The second port of each hydraulic motor is located so that as the associated piston moves from one side to the other of the second port the piston rod of the other hydraulic motor is at its maximum extension. The third port of each hydraulic motor is located so that as the associated piston moves from one side to the other of the third port the frame members are at the end portion of the relative pivoting movement.

A top dead center selector valve means is provided for being arranged in a first configuration to direct flow to the first port of, and from the fourth port of, one of the hydraulic motors while directing flow to the fourth port of, and from the first port of, the other hydraulic motor. The top dead center selector valve means also includes actuation means for arranging the top dead center selector valve means in a second configuration to reverse the flow relative to one of the hydraulic motors in response to a pressure differential between the second and fourth ports of the other hydraulic motor.

The control mechanism also includes a decelerator selector valve means for being arranged in a first configuration to direct the return flow from the hydraulic motors so as to bypass the cushioning means. The decelerator selector valve means also includes actuation means for arranging the decelerator selector valve means in a second configuration to direct the return flow to the cushioning means in response to a pressure differential between the third and fourth ports of either of the hydraulic motors.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

While this invention is susceptible of embodiment in many different forms, this specification and the accompanying drawings disclose only one specific form as an example of the use of the invention. The invention is not intended to be limited to the embodiment described, and the scope of the invention will be pointed out in the appended claims.

The figures illustrating the embodiment of the apparatus diagrammatically or schematically show structural details of conventional mechanical elements that will be recognized by one skilled in the art. However, detailed drawings and descriptions of such elements are not necessary to an understanding of the invention, and accordingly, are not herein presented.

General Arrangement Of The Apparatus

Figure 1:
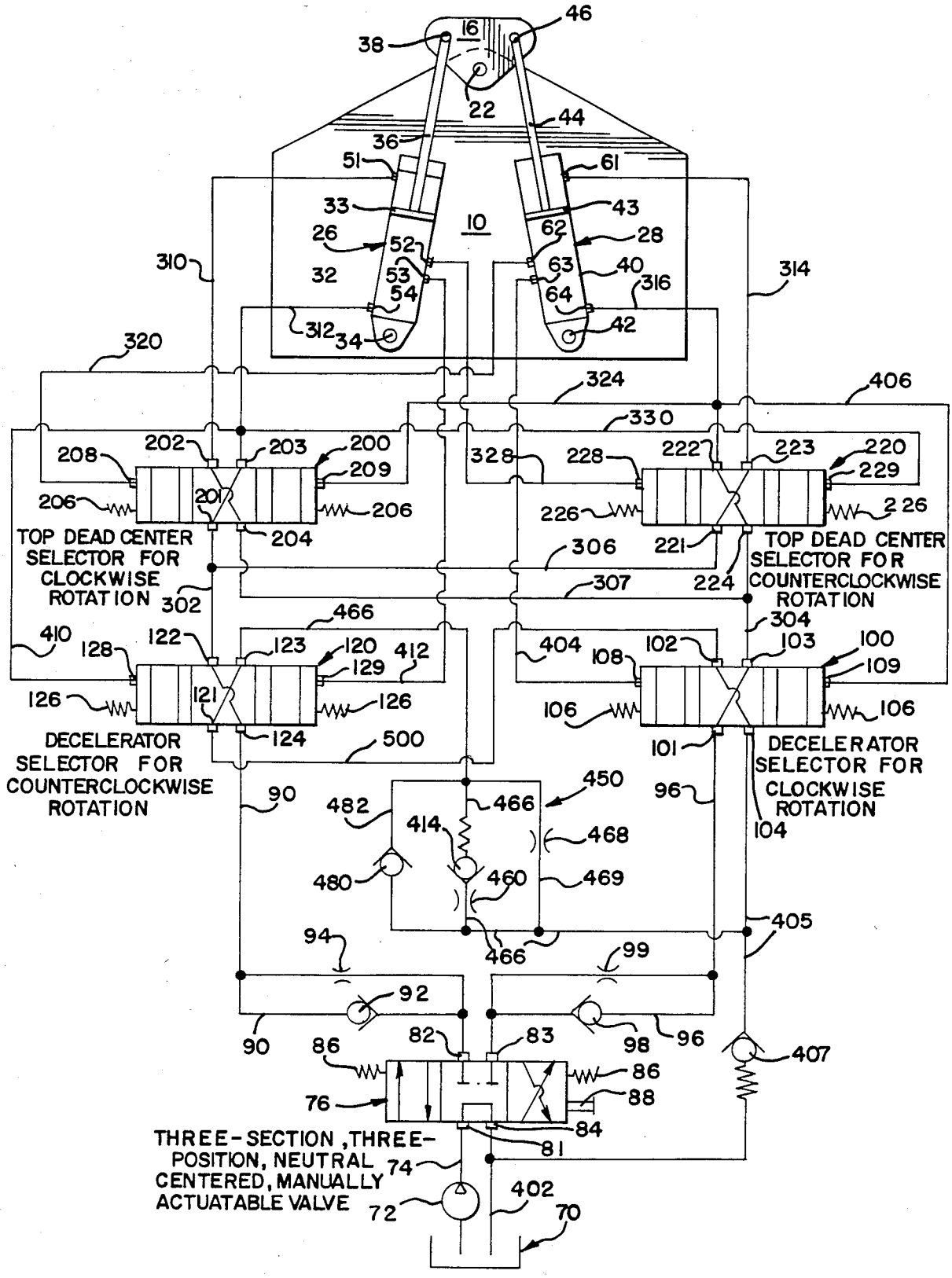
FIG. 1 is a diagrammatic and hydraulic schematic illustration of the control mechanism of the present invention shown employed to control the swing of a backhoe boom assembly.

The general arrangement of the apparatus can be best understood with reference to the drawings, especially FIG. 1. The apparatus includes a first frame member 10 and a second frame member 16. The frame members are mounted together about a pivot means or main pivot axis 22 so as to accommodate relative pivoting movement of the two frame members through an arc about the main pivot axis 22. Such an arrangement is particularly well suited for use in a backhoe wherein the frame member 10 may be the frame supported by a tractor and the frame member 16 may be the swing tower of a boom assembly.

A perspective view of such a backhoe frame and boom assembly swing tower is shown in FIG. 1 of the above-discussed U.S. Pat. No. 4,500,250. In such a backhoe, the frame member 10 is regarded as "fixed" and the boom assembly swing tower 16 is regarded as being pivotally mounted for swinging movement about the main pivot connection axis which is typically vertical.

Double-acting piston-cylinder type hydraulic motors 26 and 28 are provided for effecting the swinging movement of the swing tower frame member 16 (hereinafter called "swing tower 16" for convenience). In one type of conventional backhoe, the hydraulic motors 26 and 28 may be positioned and mounted with respect to the frame 10 and boom assembly swing tower 16 as illustrated in FIG. 1 of the above-discussed U.S. Pat. No.

4,500,250, and the illustration and description of that arrangement is incorporated herein by reference to the extent pertinent and to the extent not inconsistent herewith.

The hydraulic motor 26 comprises a cylinder 32 and piston 33 which is slidably disposed in the cylinder 32 for reciprocation therein along a stroke length. The head end of the cylinder 32 is pivotally mounted to the frame 10 about a pin or other suitable pivot means 34. A piston rod 36 extends from the rod end of the cylinder 32 and is pivotally mounted to the boom assembly swing tower 16 by means of a pin or other suitable pivot connection means 38.

The hydraulic motor 28 is identical to the hydraulic motor 26 and includes a cylinder 40 pivotally mounted at the head end of the cylinder to the frame 10 by means of a pin or other suitable pivot connection means 42. A piston 43 is slidably disposed in the cylinder 40 for reciprocation therein along a stroke length. A piston rod 44 extends from the piston 43 at the rod end of the cylinder 40 and is pivotally connected to the boom assembly swing tower 16 via a pin or other suitable pivot connection means 46.

With continued reference to FIG. 1, the first hydraulic motor 26 includes a first port 51 at the rod end beyond one end of the piston stroke length. The first hydraulic motor 26 also includes spaced-apart intermediate second and third ports 52 and 53, respectively, within the piston stroke length. Finally, the first hydraulic motor 26 includes a fourth port 54 beyond the other end of the piston stroke length.

Similarly, the second hydraulic motor 28 includes a first port 61, a second port 62, a third port 63, and a fourth port 64 which are spatially located along the cylinder 40 of the second hydraulic motor 28 in an arrangement identical to that for the ports 51, 52, 53, and 54 of the first hydraulic motor 26.

The rod end of the first hydraulic motor 26 that includes the first port 51 provides a fluid expansible chamber as does the head end that includes the fourth port 54. Similarly, the rod end of the second hydraulic motor 28 that includes the first port 61 provides a fluid expansible chamber as does the head end that includes the fourth port 64. In each hydraulic motor 26 or 28 the piston 33 or 43 reciprocates between, but not beyond, the first port 51 or 61 and the fourth port 54 or 64.

The hydraulic motor ports 51, 52, 53, and 54 and 61, 62, 63, and 64 are located in a novel arrangement along the lengths of the hydraulic motor cylinders with respect to the location of the pistons. During the pivoting movement of the swing tower 16, the pistons sequentially assume desired positions along the stroke length relative to the ports. These positions and the accompanying change in component geometry are next discussed, and the discussion is followed by a description of the other components of the system and of the detailed operation of the system.

In particular, it is to be noted that when the swing tower 16 is pivoted clockwise in the direction of the arrow 66 to the position illustrated in FIG. 3 (by the hydraulic system operation described hereinafter), the first hydraulic motor 26 has reached its fully extended, center position wherein its centerline or line of action 68 intersects the main pivot axis 22. At this orientation the axes of the first hydraulic motor pivot connections 34 and 38 are coplanar with the main pivot axis. At this point in the swinging movement of the swing tower 16, the piston 33 of the fully extended first hydraulic motor 26 is at the end of its stroke length and is at its closest position to the first port 51.

Figure 3:
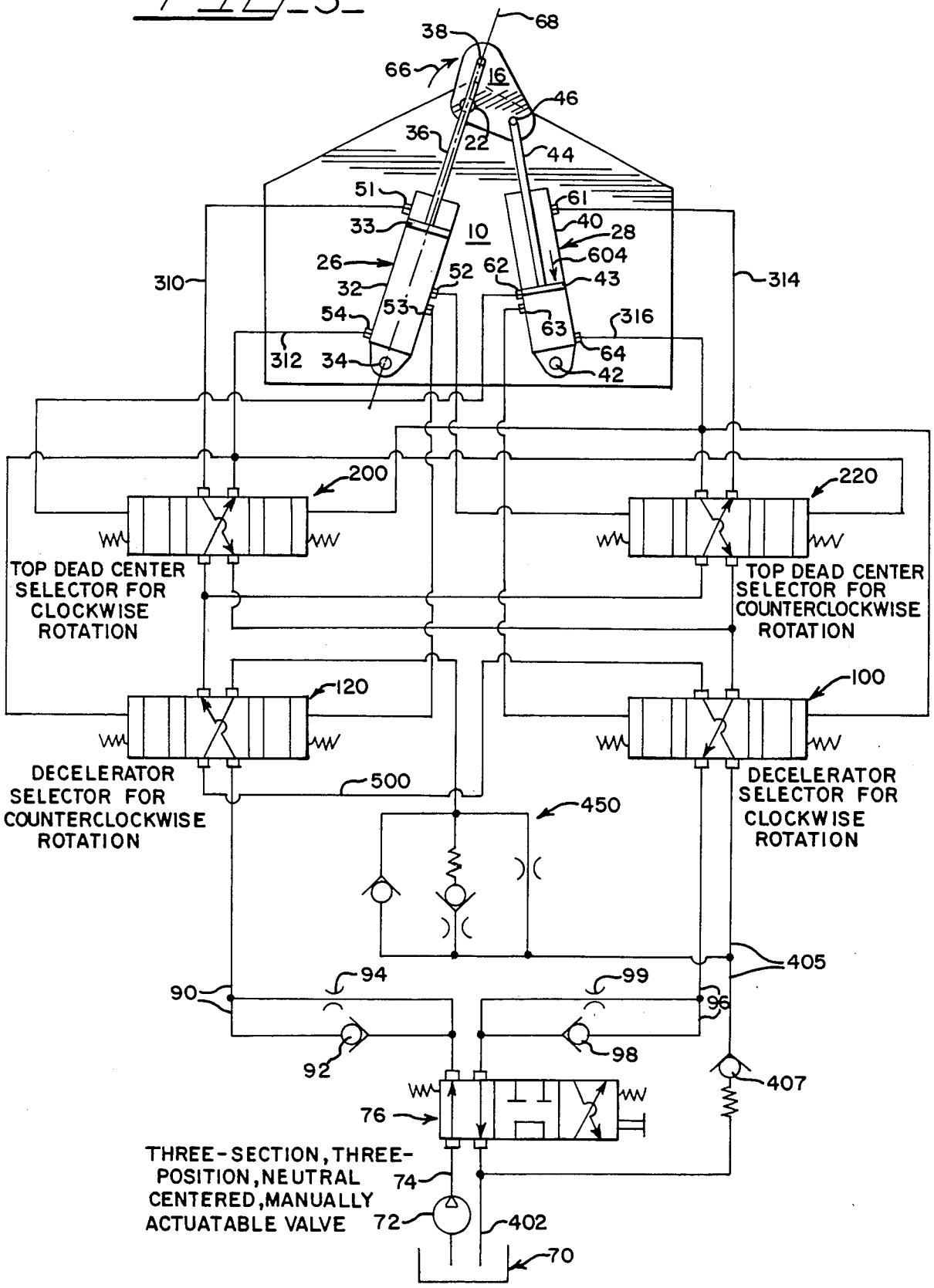
Figure 4:
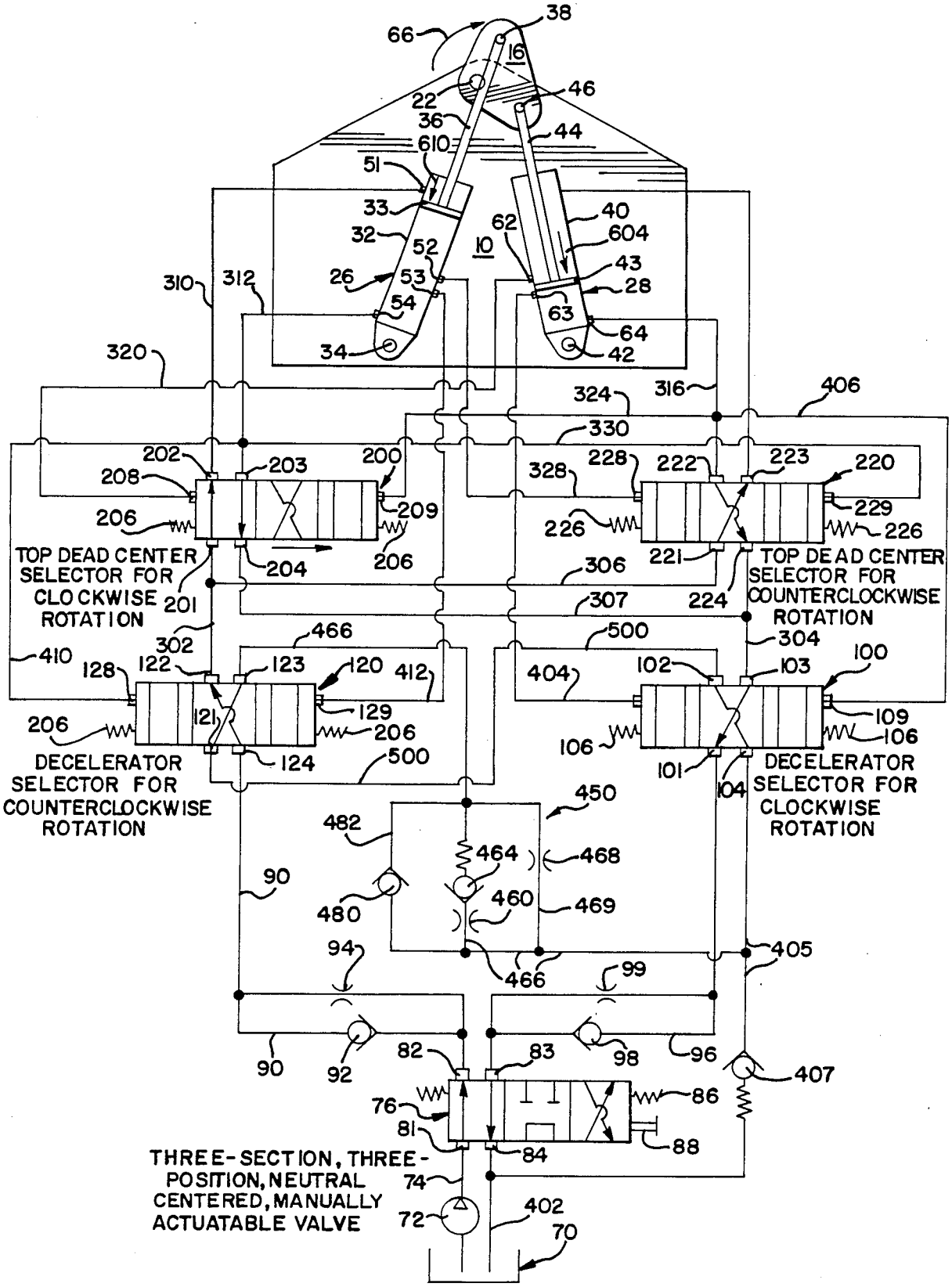

At the rotated position of the swing tower 16 illustrated in FIG. 3, the piston 43 of the second hydraulic motor 28 approaches the second port 62. Further clockwise rotation of the swing tower 16 in the direction of arrow 66 as illustrated in FIG. 4 results in the piston 43 of the second hydraulic motor crossing the second port 62 and being positioned between the second port 62 and the third port 63.

Figure 5:
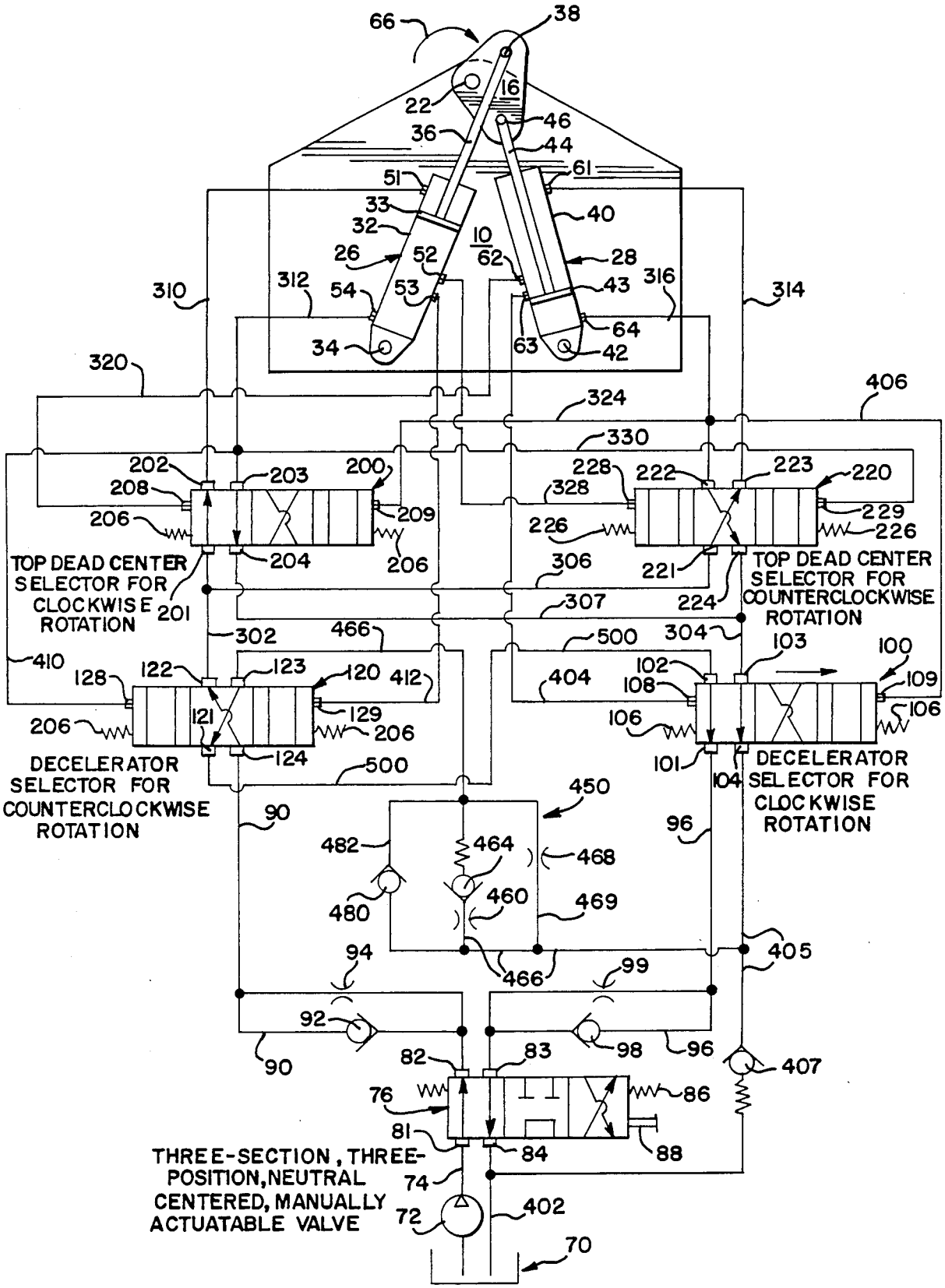

Finally, when the swing tower 16 has rotated clockwise to the end of its arc of movement indicated by the arrow 66 in FIG. 5, the piston 43 of the second hydraulic motor 28 crosses the third port 63 and is positioned between the third port 63 and the fourth port 64.

As the swing tower 16 rotates clockwise from the center position illustrated in FIG. 1 to the end of its movement illustrated in FIG. 5, the piston 33 of the first hydraulic motor 26 approaches and then moves away from the first port 51 but does not move past the second port 52 or the third port 53.

The spatial arrangement of the ports along the hydraulic motors 26 and 28 are identical so that when the swing tower 16 is rotated in the counterclockwise direction from the center position illustrated in FIG. 1, the piston 33 of the first hydraulic motor 26 is sequentially moved to and beyond the intermediate ports 52 and 53 in the same manner as described above for the second hydraulic motor piston 43 with respect to the second and third ports 62 and 63.

The hydraulic motors 26 and 28 are connected to, and operated by, a hydraulic system means for supplying a flow of fluid under pressure from a fluid source or reservoir 70 to each hydraulic motor and for returning the flow of fluid from each hydraulic motor to the source 70. The fluid is supplied under pressure by a pump 72 through a line 74 to a three-position, normally neutral-centered, manually actuatable, control valve 76. The valve 76 may be of the conventional type illustrated having a first port 81, a second port 82, a third port 83, and fourth port 84. The valve includes biasing means such as springs 86, for normally centering the valve to an intermediate position as illustrated in FIG. 1.

Figure 2:
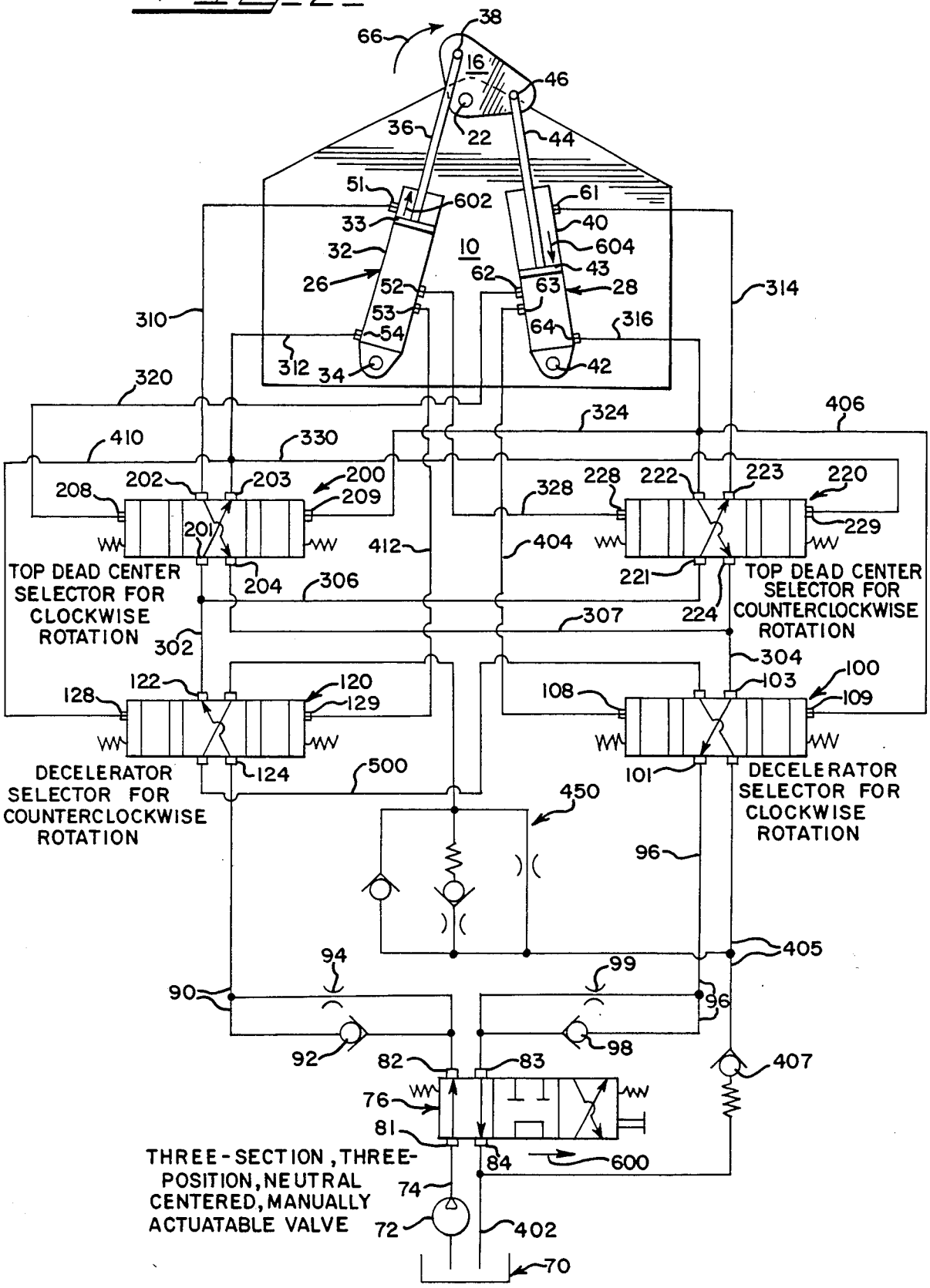
FIGS. 2–5 are views similar to FIG. 1 but illustrating the sequence of operation of the control mechanism as the boom assembly is pivoted from a mid-point position along its swing arc in a clockwise direction to its end position.

In the intermediate position, communication is established between the first port 81 and the fourth port 84 of the valve while flow through the valve ports 82 and 83 is occluded. This intermediate position may be regarded as a "second" position from which it is moveable by means of a lever 88 from a first or third position. The first position is illustrated in FIG. 2 wherein the valve 76 has been moved to the right to establish communication between the first port 81 and the second port 82 and for also establishing communication between the third port 83 and the fourth port 84.

Although not illustrated, the orientation of the valve 76 in the third position is obvious and results from movement of the valve toward the left so that communcation is established between the first port 81 and third port 83 and also between the second port 82 and the fourth port 84.

A hydraulic line 90 is connected with the second port 82 of the valve 76 and includes a conventional one-way check valve 92. A flow control orifice 94 is mounted in the hydraulic line parallel to the check valve 92. Similarly, a hydraulic line 96 is connected with the third port 83 of the valve 76 and contains a check valve 98 with a flow control orifice 99 mounted in parallel with the check valve 98.

A first pilot-actuated decelerator selector valve 100 for controlling clockwise rotation is connected to the hydraulic line 96 at a first port 101. The decelerator selector valve 100 also includes a second port 102, a third port 103, and a fourth port 104. The valve 100 may be a conventional three-position, pilot-actuated valve having a self-maintained first position as illustrated in FIG. 1 for establishing communication between the first port 101 and the third port 103 and between the second port 102 and the fourth 104.

Biasing means, such as springs 106, normally maintain the valve in the position illustrated in FIG. 1. The valve 100 has pilot actuator fluid ports 108 and 109 which, under a pressure differential, effect movement of the valve 100 to the left or to the right to establish communication between the valve ports 101 and 102 and between the valve ports 103 and 104 (as illustrated in FIG. 5 for actuation of the valve 100 to the right).

A second decelerator selector valve 120 is associated with counterclockwise rotation of the swing tower 16 and similarly has first port 121, a second port 122, a third port 123, and a fourth port 124. Springs 126 normally bias the valve 120 to the first position for establishing communication between the first port 121 and the third port 123 and between the second port 122 and the fourth port 124.

The valve 120 includes pilot actuator fluid ports 128 and 129 through which a pressure differential can be established to shift position of the valve 120 in the same manner described above for the first decelerator selector valve 100.

A first pilot-actuated top dead center selector valve 200 is provided for improving clockwise rotation torque applied to the swing tower 16 by the hydraulic motors. The decelerator selector valve 200 includes a first port 201, a second port 202, a third port 203, and a fourth port 204. The valve 200 may be a conventional three-position, pilot-actuated valve having a self-maintained first position as illustrated in FIG. 1 for establishing communication between the first port 201 and the third port 203 and between the second port 202 and the fourth 204.

Biasing means, such as springs 206, normally maintain the valve in the position illustrated in FIG. 1. The valve 200 has pilot actuator fluid ports 208 and 209 which, under a pressure differential, effect movement of the valve 200 to the left or to the right to establish communication between the valve ports 201 and 202 and between the valve ports 203 and 204 (as illustrated in FIG. 5 for actuation of the valve 200 to the right).

A second top dead center selector valve 220 is associated with counterclockwise rotation of the swing tower 16 and similarly has first port 221, a second port 222, a third port 223, and a fourth port 224. Springs 226 normally bias the valve 220 to a first position establishing communication between the first port 221 and the third port 223 and between the second port 222 and the fourth port 224. The valve 220 includes pilot actuator fluid ports 228 and 229 through which a pressure differential can be established to shift position of the valve in the same manner described above for the first top dead center selector valve 200.

The first port 201 of the first top dead center selector valve 200 is connected via a hydraulic line 302 to the second port 122 of the second decelerator selector valve 120. The fourth port 224 of the second top dead center selector valve 220 is connected via a hydraulic line 304 to the third port 103 of the first decelerator selector valve 100.

The first ports 201 and 221 of the top dead center selector valves 200 and 220, respectively, are connected together via the hydraulic lines 302 and 306. The fourth port 204 of the first top dead center selector valve 200 is connected via a hydraulic line 307 to the hydraulic line 304 which is in turn connected to the fourth port 224 of the second top dead center selector valve 220 and third port 103 of the first decelerator selector valve 100.

Further, each top dead center selector valve 200 and 220 is hydraulically connected with the hydraulic motors. In particular, the first port 51 of the first hydraulic motor 26 is connected via a hydraulic line 310 to the second port 202 of the first top dead center selector valve 200, and the fourth port 54 of the first hydraulic motor 26 is connected via a hydraulic line 312 to the third port 203 of the first top dead center selector valve 200.

The first port 61 of the second hydraulic motor 28 is connected via a hydraulic line 314 to the third port 223 of the second top dead center selector valve 220 while the fourth port 64 of the second hydraulic motor 28 is connected via a hydraulic line 316 to the second port 222 of the second top dead center selector of valve 220.

The pilot actuator fluid ports of the top dead center selector valves are also connected with the hydraulic motors. Specifically, the first top dead center selector valve 200 is connected through its left-hand actuator fluid port 208 via a hydraulic line 320 with the second port 62 of the second hydraulic motor 28. The right-hand actuator fluid port 209 of the first top dead center selector valve 200 is connected via a hydraulic line 324 to the hydraulic line 316 that is in turn connected with the fourth port 64 of the second hydraulic motor 28.

The left-hand actuator fluid port 228 of the second top dead center selector valve 220 is connected via a hydraulic line 328 with the second port 52 of the first hydraulic motor 26. The right-hand actuator fluid port 229 of the second top dead center selector valve 220 is connected via a hydraulic line 330 to the hydraulic line 312 that is in turn connected to the fourth port 54 of the first hydraulic motor 26.

A fluid discharge or return circuit is provided in the hydraulic system along with a special cushioning means or circuit 450 for restricting flow from the hydraulic motors to the source 70 during an end portion of the pivoting movement of the swing tower 16. In particular, the fourth port 84 of the control valve 76 is connected to a hydraulic return line 402 for discharging the fluid to the source or reservoir 70. The fourth port 104 of the first decelerator selector valve 100 is connected via a hydraulic line 405 to the return line 402.

A high pressure relief valve 407 is provided, as part of a cushioning means 450, in the line 405 for passing flow when the deceleration rate of the swing tower 16 is relatively great. In one system proposed for operation in accordance with teachings of the present invention, the relief valve 407 has a typical setting of 3600 pounds per square inch.

The cushioning means 450 also includes an orifice 460 mounted in series with a medium pressure relief valve 464 in a hydraulic line 466. The line 466 is connected between the third port 123 of the second decelerator selector valve 120 and the line 404 which is connected to the fourth port 104 of the first decelerator selector valve 100. The medium pressure relief valve 464, in one design proposed in accordance with the teachings of the present invention, has a typical setting of 1400 pounds per square inch.

The cushioning means also includes an orifice 468 mounted in a line 469 that is connected to the line 466 in parallel with the orifice 460 and relief valve 464.

Finally, a one-way check valve 480 is mounted in a line 482 in parallel to the orifices 460 and 468 and relief valve 464. The line 482 is connected at either end to the line 466.

Direct communication for accomodating flow directly between the two decelerator selector valves is provided via a hydraulic line 500 which is connected to the first port 121 of the second decelerator selector valve 120 and to the second port 102 of the first decelerator valve 100.

The actuator fluid ports of the decelerator selector valves 100 and 120 are in communication with the hydraulic motors 26 and 28. In particular, the first decelerator selector valve 100 is connected through its left-hand actuator fluid port 108 with the third port 63 of the second hydraulic motor 28 via a hydraulic line 404. The right-hand actuator fluid port 109 of the first decelerator selector valve 100 is connected via a hydraulic line 406 to line 316 that is connected to the fourth port 64 of the second hydraulic motor 28.

The second decelerator selector valve 120 is connected through its left-hand actuator fluid port 128 via a hydraulic line 410 to the hydraulic line 312 that is connected to the fourth port 54 of the first hydraulic port motor 26. The right-hand actuator fluid port 129 of the second decelerator selector valve 120 is connected via a hydraulic line 412 directly to the third port 53 of the first hydraulic motor 26.

Operation Of The Apparatus

The operation of the apparatus will first be described with reference to an initial position of the components as illustrated in FIG. 1. In FIG. 1, the swing tower 16 is positioned at the mid point of its swinging movement, and the hydraulic motors 26 and 28 are equally, but not fully, extended. When the swing tower 16 is in the center position, the control valve 76 is in the neutral position preventing flow through the valve into or out of the system. Operation of the apparatus to effect clockwise rotation of the swing tower 16 to its limit of travel will next be described in detail.

Clockwise rotation of the swing tower 16 is initiated by the operator moving the control valve 76 to the right as viewed in FIG. 2 and as indicated by the arrow 600 in FIG. 2. This directs the flow from the pump 72 into the control valve first port 81 and out of the second port 82. Return flow is accomodated through the control valve 76 between the third port 83 and the fourth port 84.

The incoming flow from the control valve 76 passes through the check valve 92 in line 90 and into the fourth port 124 of the second decelerator selector valve 120. (Some small amount of flow will also pass through orifice 94 and then into valve 120.) The flow exits from the second port 122 of the decelerator selector valve 120 into line 302, and part of the flow enters the first port 201 of the first top dead center selector valve 200 while another part of the flow is directed via line 306 to the first port 221 of the second top dead center selector valve 220.

The flow exits from the third port 203 of the first top dead center selector valve 200 and enters the fourth port 54 of the first hydraulic motor 26 to urge the piston 33 upperwardly to apply clockwise torque to the swing tower 16. Flow also exits from the third port 223 of the second top dead center selector valve 220 and enters the first port 61 of the second hydraulic motor 28 for urging the piston 43 to apply clockwise torque to the swing tower 16.

Fluid is discharged from the first hydraulic motor 26 through the first port 51 into line 310 to the second port 202 of the first top dead center selector valve 200. Fluid is also discharged from the second hydraulic motor 28 through the fourth port 64 into line 316 which directs the flow to the second port 222 of the second top dead center selector valve 220.

The flow discharges from the first top dead center selector valve 200 at the fourth port 204 and flows via the hydraulic line 307 to the hydraulic line 304 where it joins the flow discharging from the fourth port 224 of the second top dead center selector valve 220. The combined discharge flow enters the third port 103 of the decelerator selector valve 100 and exits the valve from the first port 101 into the hydraulic line 96 where it passes through the orifice 99 to the source or reservoir 70 via the control valve 76 and return line 402.

The top dead center selector valves 200 and 220 and the decelerator selector valves 100 and 120 initially remain in the position shown in FIG. 2 as a result of the biasing springs and the equal pilot pressure on both ends of each valve. In particular, the pilot pressure is initially the same at the actuator fluid ports 228 and 229 of the second top dead center selector valve 220 and is initially equal to the pressure at the cylinder head end of the first hydraulic motor 26. This is because the first hydraulic motor second port 52 and fourth port 54 are initially subjected to the same cylinder pressure, and that pressure is transmitted from the second port 52 through the hydraulic line 328 to the actuator fluid port 228 of the second top dead center selector valve 220 while that same pressure is also transmitted from the fourth port 54 of the first hydraulic actuator 26 through the hydraulic lines 312 and 330 to the actuator fluid port 229 of the second top dead center selector valve 220.

Similarly, the pilot pressure is initially the same at the actuator fluid ports 208 and 209 of the first top dead center selector valve 200 and is initially equal to the pressure at the cylinder head end of the second hydraulic motor 28. This is because the second hydraulic motor second port 62 and fourth port 64 initially are subjected to the same cylinder pressure, and that pressure is transmitted from the second port 62 through the hydraulic line 320 to the actuator fluid port 208 of the second top dead center selector valve 220 while that same pressure is also transmitted from the fourth port 64 of the second hydraulic actuator 28 through the hydraulic lines 316 and 324 to the actuator fluid port 209 of the first top dead center selector valve 200.

The positions of the two decelerator selectors valves 100 and 120 are initially maintained as illustrated in FIG. 2 in a manner analogous to that described above for the top dead center selector valves 200 and 220. In particular, the decelerator selector valves 100 and 120 initially remain in the position illustrated in FIG. 2 owing to the action of the springs and owing to the equal pilot pressure on both ends of each valve. The pressure at the actuator fluid ports 108 and 109 of the first decelerator selector valve 100 is initially equal to the pressure in the head end of the second hydraulic motor 28 via transmission of that pressure through the third port 63 and line 404 to the actuator fluid port 108 and via transmission of that pressure through the second hydraulic motor fourth port 64, line 316, and line 406 to the actuator fluid port 109.

The pilot pressure at each end of the second decelerator selector valve 120 is initially equal to the pressure in the cylinder head end of the first hydraulic motor 26 via transmission that pressure through the first hydraulic motor third port 53 and hydraulic line 412 to the actuator fluid port 129 of the decelerator selector valve 120 and by transmission of that pressure through the first hydraulic motor fourth port 54, line 312, and line 410 to the actuator fluid port 128 of the second decelerator selector valve 120.

As the operator continues to hold the control valve 76 in the position illustrated in FIG. 2, the first hydraulic motor piston 33 continues to move in the direction of the arrow 602, and the second hydraulic piston 43 continues to move in the direction of arrow 604. This causes additional rotation of the swing tower 16 until the swing tower 16 and hydraulic motors are oriented as illustrated in FIG. 3.

The design and arrangement of the system is such that at the configuration illustrated in FIG. 3, the first hydraulic motor 26 has become fully extended and its centerline (line of action) 68 intersects the main pivot axis 22 (i.e., the axes of the hydraulic motor pivot connections 34 and 38 are coplanar with the main pivot axis 22).

Further rotational movement of the swing tower 16 in the clockwise direction of the rotation (indicated by the arrow 66) would force the first hydraulic motor 26 into an overcenter condition where it is less than fully extended. Further, unless the pressurization of the first hydraulic motor piston was reversed, the first hydraulic motor would be acting to apply counterclockwise torque to the swing tower 16. This would be acting against the clockwise torque applied by the second motor 28. In accordance with the teachings of the present invention, the apparatus instead permits the pressurization to the first hydraulic motor 26 to be reversed so that the first hydraulic motor 26 can continue to supply supplemental clockwise torque to the swing tower 16 as will next be explained.

Specifically, with reference to FIGS. 3 and 4, it is seen that when the first hydraulic motor 26 is in its fully extended position at the overcenter point, the piston 43 of the second hydraulic motor 28 is approaching and crossing the second port 62 of the second hydraulic motor 28 as indicated by arrow 604. FIG. 4 illustrates the orientation of the components just after the first hydraulic motor 26 has passed the overcenter point. The piston 43 of the second hydraulic motor 28 is seen to have crossed the second port 62. Thus, the second port 62 is subjected to the rod end pressure which is transmitted through the hydraulic line 320 to the actuator fluid port 208 of the first top dead center selector valve 200. However, that valve's other actuator fluid port 209 remains subjected to the pressure at the head end of the cylinder of the second motor 28 through hydraulic lines 324 and 316 connected to the fourth port 64. Owing to the pressure differential between the first top dead center selector valve's actuator fluid ports 208 and 209, the selector valve 200 shifts to the right as illustrated in FIG. 4.

After the first top dead center selector valve has shifted to the right as illustrated in FIG. 4, the flow into and out of the first hydraulic motor 26 through lines 310 and 312 is necessarily reversed. Accordingly, the first hydraulic motor piston 33 is urged downwardly in the direction of the arrow 610 as illustrated in FIG. 4. This provides additional torque for rotating the swing tower 16 in the clockwise direction designated by the arrow 66.

Continued pressurization of the hydraulic motors 26 and 28 results in continued rotation of the swing tower 16 to the end of the swing arc for which the apparatus is designed, and that end position is illustrated in FIG. 5. In order to effect hydraulic cushioning of the swing tower 16 as it approaches the end of its travel (at which conventional travel stops (not illustrated) may be provided), the apparatus operates to selectively employ the cushioning means 450. To this end, it is apparent from FIG. 5 that as the swing tower 16 approaches the end of its travel, the piston 43 of the second hydraulic motor 28 approaches the fully retracted position and crosses the third port 63. The third port 63 is thus then subjected to the hydraulic motor supply pressure which is transmitted through hydraulic line 404 to the actuator fluid port 108 of the first decelerator selector valve of 100. It will be appreciated, however, that the fourth port 64 is subjected to the hydraulic motor outlet pressure which is transmitted through hydraulic lines 316 and 406 to the actuator fluid port 109 of the first decelerator selector valve 100. Accordingly, the pressure differential across the actuator ends of the valve 100 moves the valve to the position illustrated in FIG. 5. In this position, the valve 100 directs flow entering its third port 103 out of its fourth port 104 and also establishes communication between the second port 102 and first port 101.

It is to be noted that the return flow from the first hydraulic motor 26 continues to pass out of the first hydraulic motor fourth port 54, through hydraulic line 312, through the first top dead center selector valve 200, through the hydraulic line 307, and into the hydraulic line 304. Hydraulic line 304 is also passing the return flow from the second hydraulic motor 28 which flows from the second hydraulic motor fourth port 64, through hydraulic line 316, through the second top dead center selector valve 220, and into the hydraulic line 304. The combined return flow of the hydraulic motors is then directed by the actuated first decelerator selector valve 100 from the hydraulic line 304 to the hydraulic line 405.

The combined flow in hydraulic line 405 flows to the cushioning means which includes the orifice 460 and medium pressure relief valve 464, the orifice 468, and the high pressure relief valve 407. At low deceleration rates, the return fluid passes through hydraulic line 466, hydraulic line 469 and orifice 468 to the third port 123 of the second decelerator selector valve 120. The return flow exits from the first port of the second decelerator selector valve 120 into the hydraulic line of 500 which directs the flow to the second port 102 of the first decelerator selector valve 100. The flow exits the valve 100 from the first port 101 into the hydraulic line 96, through orifice 99, and through the control valve 76 back to the source or reservoir 70.

For medium deceleration rates, some of the return flow also passes through the cushioning means orifice 460 and the medium pressure relief valve 464 in parallel with the flow through the orifice 468.

For high deceleration rates, some of the flow from the fourth port 104 of the first decelerator selector valve 100 passes through hydraulic line 405 to and through the high pressure relief valve 407. The high pressure relief valve 407 discharges its portion of the return flow directly to the source or reservoir 70 via the main return line 402.

The swing tower 16 can be rotated from the end position illustrated in FIG. 5 back in the counterclockwise direction by actuating the control valve 76 all the way to the left. Although this is not illustrated, it is clear that when the control valve 76 is moved all the way to the left, the inlet flow from the first port 81 will discharge from the third port 83 while the fourth port 84 will be in communication with the second port 82. The flow from the pump 72 will thus be directed out of the control valve 76 and through the check valve 98 in line 96. In addition, there will be a small flow through the orifice 99 in parallel with the flow through the check valve 98.

With continued reference to FIG. 5 (but assuming control valve 76 remains moved all the way to the left from the position illustrated), the combined flow in line 96 will enter the first port 101 of the still-actuated first decelerator selector valve 100 and pass out the second port 102 to the hydraulic line 500. From hydraulic line 500 the flow enters the second decelerator selector valve 120 at the first port 121 and passes from that valve out of the third port 123 into the hydraulic line 466. The flow in hydraulic line 466 enters the hydraulic line 482 and passes through check valve 480 into the hydraulic line 466. The flow from the line 466 discharges to the line 405 and enters the fourth port 104 of the first decelerator selector valve 100.

The flow passes out of the third port 103 of the first decelerator selector valve 100 and into the hydraulic line 304. The flow in the hydraulic line 304 splits, with one half entering the fourth port 224 of the second top dead center selector valve 220 and one half passing through hydraulic line 307 to the fourth port 204 of the first top dead center selector valve 200.

The flow exits from the third port 203 of the first top dead center selector valve 200 into line 312 which directs it into the fourth port 54 of the first hydraulic motor 26. The flow exits from the second top dead center selector valve 220 from the second port 222 into the line 316 which directs it into the fourth port 64 of the second hydraulic motor 28.

The pressurization of the pistons in the hydraulic motors 26 and 28 is thus reversed so that the motors begin to extend for rotating the swing tower 16 in the counterclockwise direction away from the end point position illustrated in FIG. 5. Flow is discharged from the first port 51 of the first hydraulic motor 26 and from the first port 61 of the second hydraulic motor 28. The flow from the first motor 26 is directed by line 310 through the still-actuated first top dead center selector valve 200 to line 302. The flow from the second motor 28 is directed by line 314 through the second top dead center selector valve to line 306 that connects to line 302. The combined flow from the hydraulic motors in line 302 flows through the second decelerator selector valve 120 into line 90, through orifice 94, and through control valve 402 back to the reservoir 70.

The remaining sequence of operation in the counterclockwise direction is substantially the reverse of what has been described hereinbefore with respect to clockwise rotation of the swing tower 16. Consequently, in view of the foregoing discussion, it is not necessary to describe the remaining sequence of the counterclockwise rotation in step-by-step detail since that operation will be apparent to one skilled in the art.

It is seen that the novel apparatus of the present invention uniquely senses the hydraulic motor position by employing hydraulic pressure differentials which actuate valves to provide improved torque characteristics and also to provide cushioning of the swing tower 16 as it approaches either end of its arc of travel. In this regard, the two top dead center selector valves 200 and 220 may be regarded as functioning as a means for directing flow to selected ends of the two hydraulic motors and for subsequently reversing the flow relative to one of the hydraulic motors in response to a pressure differential between ports of the other of the hydraulic motors.

Further, the two decelerator selector valves 100 and 120 may be regarded as functioning as means for directing the return flow from the hydraulic motors so as to bypass the cushioning means when the swing tower is not at the end portions of its arc of travel and for directing the return flow through the cushioning means in response to a pressure differential between selected ports of either of the hydraulic motors when the swing tower is in an end portion of its arc of travel.

The novel apparatus avoids the use of exposed mechanical devices that are vulnerable to damage by impact from external objects or that are vulnerable to damage by mechanical wear or external environmental conditions.

From the foregoing, it will be observed that numerous variations and modifications may be effected without departing from the true spirit and scope of the novel consept of the present invention. It will be understood that no limitation with respect to the specific apparatus illustrated herein is intended or should be inferred. It is, of course, intended to cover by the appended claims all such modifications as follow in the scope of the claims.

What is claimed is:

1. In an apparatus having (1) two double-acting piston-cylinder type hydraulic motors each pivotally connected at each end to one of two frame members for effecting relative pivoting movement of said frame members through an arc about a main pivot axis wherein each said hydraulic motor is fully extended when its respective line of action intersects said main pivot axis, (2) a hydraulic system means connected to said two hydraulic motors for supplying a flow of fluid under pressure from a source of fluid to each said hydraulic motor and for returning the flow of fluid from each said hydraulic motor to said source, and (3) cushioning means connected with said hydraulic system means for restricting flow from both said hydraulic motors to said source during an end portion of the relative pivoting movement of said frame members through said arc, a mechanism for controlling said pivoting movement comprising:

(a) each said hydraulic motor having a first port beyond one end of the piston stroke length, spaced-apart intermediate second and third ports within the piston stroke length, and a fourth port beyond the other end of the piston stroke length, said second port of each said hydraulic motor being located so that as the associated piston moves from one side to the other of said second port the piston rod of the other hydraulic motor is at its maximum extension, said third port of each said hydraulic motor being located so that as the associated piston moves from one side to the other of said third port said frame members are at said end portion of relative pivoting movement;

(b) top dead center selector valve means for being arranged in a first configuration to direct flow to the first port of, and from the fourth port of, one of said hydraulic motors while directing flow to the fourth port of, and from the first port of, the other hydraulic motor and including actuation means for arranging said top dead center selector valve means in a second configuration to reverse the flow relative to one of said hydraulic motors in response to a pressure differential between the second and fourth ports of the other of said hydraulic motors; and (c) decelerator selector valve means for being arranged in a first configuration to direct the return flow from said hydraulic motors so as to bypass said cushioning means and including actuation means for arranging said decelerator selector valve means in a second configuration to direct the return flow to said cushioning means in response to a pressure differential between the third and fourth ports of either of said hydraulic motors.

2. The apparatus in accordance with claim 1 in which said top dead center selector valve means includes two pilot-actuated top dead center selector valves;

said decelerator selector valve means includes two pilot-actuated decelerator selector valves; and one of said top dead center selector valves and one of said decelerator selector valves are actuated during the stroke of the piston of one of said hydraulic motors past its second and third ports, respectively, and the other top dead center selector valve and the other decelerator selector valve are actuated during the stroke of the piston of the other of said hydraulic motors past its second and third ports, respectively.

3. The apparatus in accordance with claim 1 in which said decelerator selector valve means includes two pilot-actuated decelerator selector valves; and said apparatus further includes a control valve means for selectively directing supply flow to either of said two decelerator selector valves.

4. The apparatus in accordance with claim 3 in which said cushioning means includes a first orifice and first relief valve connected in series with each other, a second orifice connected in parallel with said first orifice and first relief valve, and a second relief valve connected in parallel with said first relief valve and said first and second orifices; and said control valve is connected in series with said first relief valve and first and second orifices and is connected in parallel with said second relief valve.

5. In an apparatus having (1) two hydraulic motors for effecting relative pivoting movement of two frame members through an arc about a main pivot axis wherein each said hydraulic motor has a cylinder mounted via a pivot connection to one of said frame members and has a piston slidably disposed in said cylinder for reciprocation therein along a stroke length with a piston rod extending from said piston to a pivot connection with the other of said frame members so that said piston rod reaches its maximum extension when the axes of the pivot connections of said piston rod and associated cylinder are coplanar with said main pivot axis, (2) a hydraulic system means connected to said two hydraulic motors for supplying a flow of fluid under pressure from a source of fluid to each said hydraulic motor and for returning the flow of fluid from each said hydraulic motor to said source, and (3) cushioning means connected with said hydraulic system means for restricting flow from both said hydraulic motors to said source during an end portion of the relative pivoting movement of said frame members through said arc, a mechanism for controlling said pivoting movement comprising:

(a) each said hydraulic motor having a first port beyond one end of said piston stroke length, spaced-apart intermediate second and third ports within said piston stroke length, and a fourth port beyond the other end of said piston stroke length, said second port of each said hydraulic motor being located so that as the associated piston moves from one side to the other of said second port the piston rod of the other hydraulic motor is at its maximum extension, said third port of each said hydraulic motor being located so that as the associated piston moves from one side to the other of said third port said frame members are at said end portion of relative pivoting movement;

(b) top dead center selector valve means for being arranged in a first configuration to direct flow to the first port of, and from the fourth port of, one of said hydraulic motors while directing flow to the fourth port of, and from the first port of, the other hydraulic motor and including actuation means for arranging said top dead center selector valve means in a second configuration to reverse the flow relative to one of said hydraulic motors in response to a pressure differential between the second and fourth ports of the other of said hydraulic motors; and (c) decelerator selector valve means for being arranged in a first configuration to direct the return flow from said hydraulic motors so as to bypass said cushioning means and including actuation means for arranging said decelerator selector valve means in a second configuration to direct the return flow to said cushioning means in response to a pressure differential between the third and fourth ports of either of said hydraulic motors.

6. The apparatus in accordance with claim 5 in which said decelerator selector valve means is in communication with said top dead center selector valve means for directing flow through said top dead center selector valve means to said hydraulic motors and for selectively directing the return flow from said hydraulic motors out of said top dead center selector valve means to pass through or to bypass said cushioning means.

7. The apparatus in accordance with claim 5 in which said actuation means of said top dead center selector valve means includes pilot actuators in communication with said second and fourth ports of each of said hydraulic motors and in which said actuation means of said decelerator selector valve means includes pilot actuators in communication with said third and fourth ports of each of said hydraulic motors.

8. In an apparatus having (1) a frame, (2) a boom assembly swing tower mounted to said frame for pivoting movement through an arc relative to said frame about a main pivot axis, (2) first and second hydraulic motors for effecting said pivoting movement of said boom assembly wherein each said hydraulic motor has a rod end and a head end providing respective fluid expansible chambers, wherein each said hydraulic motor has a cylinder mounted at said head end via a pivot connection to one of said frame and boom assembly and has a piston slidably disposed in said cylinder for reciprocation therein along a stroke length with a piston rod extending from said piston at said rod end to a pivot connection with the other one of said frame and boom assembly so that said piston rod reaches its maximum extension when the axes of said pivot connections of said piston rod and associated cylinder are coplanar with said main pivot axis, (4) a hydraulic system means connected to said two hydraulic motors for supplying a flow of fluid under pressure from a source of fluid to each said hydraulic motor and for returning the flow of fluid from each said hydraulic motor to said source, and (5) cushioning means connected with said hydraulic system means for restricing flow from both said hydraulic motors to said source during an end portion of the pivoting movement of said boom assembly through said arc, a mechanism for controlling said pivoting movement comprising:

(a) each said hydraulic motor having a first port at said rod end beyond one end of said piston stroke length, spaced-apart intermediate second and third ports within said piston stroke length, and a fourth port at said head end beyond the other end of said piston stroke length arranged so that, as said piston moves in said cylinder from said one end of its stroke length to said other end of its stroke length, said piston moves sequentially from between said first and second ports to between said second and third ports and lastly to between said third and fourth ports, said second port of each said hydraulic motor being located so that as the associated piston moves from one side to the other of said second port the piston rod of the other hydraulic motor is at its maximum extension, said third port of each said hydraulic motor being located so that as the associated piston moves from one side to the other of said third port said swing tower is at said end portion of its pivoting movement;

(b) a first pilot-actuated top dead center selector valve having a normally self-maintained first position for directing flow to said first hydraulic motor fourth port while directing flow out of said first hydraulic motor first port and having a second position for directing flow to said first hydraulic motor first port while directing flow out of said first hydraulic motor fourth port, said first top dead center selector valve including pilot actuator means connected to the second and fourth ports of said second hydraulic motor for actuating said first top dead center selector valve from said first position to said second position in response to a pressure differential between said second hydraulic motor second and fourth ports;

(c) a second pilot-actuated top dead center selector valve having a normally self-maintained first position for directing flow to said second hydraulic motor first port while directing flow out of said second hydraulic motor fourth port and having a second position for directing flow to said second hydraulic motor fourth port while directing flow out of said second hydraulic motor first port, said second top dead center selector valve including pilot actuator means connected to the second and fourth ports of said first hydraulic motor for actuating said second top dead center selector valve from said first position to said second position in response to a pressure differential between said first hydraulic motor second and fourth ports;

(d) a first pilot-actuated decelerator selector valve having a normally self-maintained first position for providing communication between said hydraulic system means and said first and second top dead center selector valves and having a second position for directing the return flow from said first and second top dead center selector valves to said cushioning means, said first decelerator selector valve including pilot actuator means connected to the third and fourth ports of said second hydraulic motor for actuating said first decelerator selector valve from said first position to said second position in response to a pressure differential between said second hydraulic motor third and fourth ports; and (e) a second pilot-actuated decelerator selector valve having a normally self-maintained first position for providing communication between said hydraulic system means and said first and second top dead center selector valves and having a second position for directing the return flow from said first and second top dead center selector valves to said cushioning means, said second decelerator selector valve including pilot actuator means connected to the third and fourth ports of said first hydraulic motor for actuating said second decelerator selector valve from said first position to said second position in response to a pressure differential between said first hydraulic motor third and fourth ports.

9. The apparatus in accordance with claim 8 in which the piston rod of each said hydraulic motor is pivotably connected to said boom assembly swing tower and in which the head end of each said hydraulic motor is pivotably connected to said frame.

10. The apparatus in accordance with claim 8 in which said cushioning means includes at least one orifice connected between said first and second pilot-actuated decelerator selector valves for receiving at least a portion of the flow directed to it by one of said decelerator selector valves and for discharging that flow to the other of said decelerator selector valves when said one decelerator selector valve is in said second position.

11. An apparatus for effecting and controlling relative pivoting movement of two frame members through an arc about a main pivot axis comprising:

(a) first and second hydraulic motors for effecting relative pivoting movement of said frame members, each said hydraulic motor having a rod end and a head end providing respective fluid expansible chambers, each said hydraulic motor having a cylinder mounted at said head end via a pivot connection to one of said frame members and a piston slidably disposed in said cylinder for reciprocation therein along a stroke length with a piston rod extending from said piston at said rod end to a pivot connection with the other of said frame members so that said piston rod reaches its maximum extension when said pivot connections of said piston rod and associated cylinder are coplanar with said main pivot axis, each said hydraulic motor having a first port beyond one end of said piston stroke length, spaced-apart intermediate second and third ports within said piston stroke length, and a fourth port beyond the other end of said piston stroke length arranged so that, as said piston moves in said cylinder from one end of its stroke length to the other end of its stroke length, said piston moves from between said first and second ports to between said second and third ports when the piston rod of the other hydraulic motor reaches its full extension, and then to between said third and fourth ports during an end portion of the relative pivoting movement of said frame members through said arc;

(b) a hydraulic system means connected to said two hydraulic motors for supplying fluid under pressure from a source of fluid to each said hydraulic motor and for returning the fluid from each said hydraulic motor to said source, (c) two pilot-actuated top dead center selector valves connected with said hydraulic system means with each top dead center selector valve being associated with one direction of rotation and having (1) first, second, third and fourth main ports, (2) a normally self-maintained first position for establishing communication between said top dead center selector valve first and third main ports and between said top dead center selector valve second and fourth main ports, (3) biasing means for normally maintaining said top dead center selector valve in said first position, (4) a second pilot-actuated position for establishing communication between said top dead center selector valve first and second main ports and between said top dead center selector valve third and fourth main ports, and (5) first and second pilot ports connected to the second and fourth ports, respectively, of one of said hydraulic motors through which said top dead center selector valve can be subjected to a pressure differential for actuating said top dead center selector valve to said second position;

(d) two pilot-actuated decelerator selector valves connected with said hydraulic system means with each decelerator selector valve being associated with one direction of rotation and having (1) first, second, third and fourth main ports, (2) a normally self-maintained first position for establishing communication between said decelerator selector valve first and third main ports and between said decelerator selector valve second and fourth main ports, (3) biasing means for normally maintaining said decelerator selector valve in said first position, (4) a second pilot-actuated position for establishing communication between said decelerator selector valve first and second main ports and between said decelerator selector valve third and fourth main ports, and (5) first and second pilot ports connected to the third and fourth ports, respectively, of one of said hydraulic motors through which said decelerator selector valve can be subjected to a pressure differential for actuating said decelerator selector valve to said second position;

(e) a three-position, normally neutral centered, actuatable control valve connected with said hydraulic system means and having (1) first, second, third and fourth main ports, (2) a first position for establishing communication between said control valve first and second main ports and between said control valve third and fourth main ports, (3) an intermediate second position which is centered for establishing communication between said control valve first and fourth main ports while occluding flow through said control valve second and third main ports, (4) a third position for establishing communication between said control valve first and third main ports and between said control valve second and fourth main ports, and (5) biasing means for normally centering said control valve to said intermediate second position; and (f) cushioning means connected with said hydraulic system means for restricting flow from both said hydraulic motors to said source during an end portion of the relative pivoting movement of said frame members through said arc in response to pilot actuation of one of said decelerator selector valves.

* * * * *